US006948532B2

(12) United States Patent
Berktold

(10) Patent No.: US 6,948,532 B2
(45) Date of Patent: Sep. 27, 2005

(54) METHOD AND APPARATUS FOR THE WEFT INSERTION IN A JET WEAVING MACHINE

(75) Inventor: Klaus Berktold, Rüti (CH)

(73) Assignee: Sultex AG, Rueti (CH)

( * ) Notice: Subject to any disclaimer, the term of this patent is extended or adjusted under 35 U.S.C. 154(b) by 124 days.

(21) Appl. No.: 10/411,979

(22) Filed: Apr. 10, 2003

(65) Prior Publication Data

US 2003/0192614 A1 Oct. 16, 2003

(30) Foreign Application Priority Data

Apr. 11, 2002 (EP) ..... 02405290

(51) Int. Cl.[7] ..... D03D 47/36

(52) U.S. Cl. ..... 139/452; 139/453; 139/370.2; 66/132 R

(58) Field of Search ..... 139/452, 453, 139/370.2; 66/132 R

(56) References Cited

U.S. PATENT DOCUMENTS 4,407,336 A * 10/1983 Steiner ..... 139/452
4,541,462 A * 9/1985 Tholander ..... 139/452
4,607,668 A * 8/1986 Tholander ..... 139/452
4,617,971 A * 10/1986 Hellstroem ..... 139/370.2
4,702,285 A * 10/1987 Sugita ..... 139/452
4,715,411 A * 12/1987 Van Bogaert et al. ..... 139/452
4,739,942 A * 4/1988 Maenaka ..... 242/365.4
4,746,848 A * 5/1988 Maenaka et al. ..... 318/603
5,322,090 A * 6/1994 Dornier et al. ..... 139/452
5,590,547 A * 1/1997 Conzelmann ..... 66/132 R

FOREIGN PATENT DOCUMENTS

EP 0264985 A1 4/1988
EP 0561218 A1 9/1993

* cited by examiner

*Primary Examiner*—John J. Calvert
*Assistant Examiner*—Robert H Muromoto
(74) *Attorney, Agent, or Firm*—Townsend and Townsend and Crew LLP

(57) ABSTRACT

A method for the weft insertion in a jet weaving machine is proposed, in which in each work cycle a weft thread (S1) of predeterminable length which is to be inserted is drawn off from a winding drum (3) of a thread supply apparatus (2), the weft thread (S1) is inserted into an open shed (17) by means of a main nozzle (11) which is fed with a transport medium, is bound in into the cloth (G) through the change of shed, and is severed at the cloth edge which is near the main nozzle (11). In each work cycle the drawing off of the weft thread (S1) to be inserted is interrupted at least once in such a manner that at first a first predeterminable thread length is released for the drawing off from the winding drum (3) and then at least one further predeterminable thread length is also released for the drawing off from the winding drum (3).

14 Claims, 4 Drawing Sheets

METHOD AND APPARATUS FOR THE WEFT INSERTION IN A JET WEAVING MACHINE

BACKGROUND OF THE INVENTION

The invention relates to a method and to an apparatus for the weft insertion in a jet weaving machine where during each work cycle a weft thread of predeterminable length which is to be inserted is drawn off from a winding drum of a thread supply apparatus, the weft thread being inserted into an open shed by means of a main nozzle which is fed with a transport medium, is bound into the cloth through the change of shed, and is severed at the cloth edge which is near the main nozzle.

In jet weaving machines the weft insertion takes place by means of a transport medium which inserts the respective weft thread through the open shed. In air jet weaving machines this transport medium is air.

For the weft insertion a definite and predeterminable thread length, which is naturally dependent on the weaving width, is in each case drawn off from the stationary winding drum of a thread supply apparatus and is supplied to a main nozzle. The main nozzle is fed with compressed air and accelerates the weft thread into the open shed. In particular in the case of air jet weaving machines running at high rotational speeds the main nozzle is typically arranged stationary with respect to the sley, so that the main nozzle carries out the oscillatory movement synchronously with the sley. It is also known, in particular in the case of large weaving widths, to provide a pre-nozzle which is fed with air between the thread supply apparatus and the main nozzle in order to increase the acceleration path for the weft thread. A plurality of auxiliary or relay nozzles, which are likewise fed with compressed air, are usually provided along the weft insertion path. After a successful weft insertion the front end of the weft thread is e.g. taken and held by a stretch nozzle and the weft thread is beat up to the cloth by the sley. Then the change of shed takes place, through which the weft thread is bound in over the entire weaving width. Then the thread must be severed on the insertion side between the main nozzle and the cloth edge which is near it in order to be prepared for the next weft insertion.

Special problems arise in particular when weaving with relatively elastic weft yarns and/or when weaving over large weaving widths of for example four to five meters or more. One problem is that high tensions are present in the thread through the strong draw forces. If now the thread is severed at the insertion side after the change of shed, then it often happens that the severed thread end jumps out backwards, that is, contrary to the weft insertion direction, to the rear out of the main nozzle. This makes a stopping of the weaving machine necessary in order that the end of the thread can be inserted again into the main nozzle. An attempt is admittedly made to solve this problem in that during and after the severing the main nozzle is fed with a retaining air flow, which is intended to hold the thread end in the main nozzle. The result is however unsatisfactory. A lengthening of the nozzle likewise does not lead to a satisfactory result.

A further problem arises in particular through the high acceleration forces which must be exerted by means of the air on the weft thread. At the beginning of the weft insertion there is the danger that the beginning of the weft thread which is accelerated out of the main nozzle does not encounter the entry of the insertion passage. This leads to the formation of knot-like curls or kinks, which as a rule result in stopping of the weaving machine. At the end of the weft insertion the weft thread must be strongly braked. The large deceleration forces which are required for this can lead to so-called stopping or stretching jolts, which means that a tearing of the weft thread arises at the insertion side through the strong braking. The weaving machine must be stopped. In order to avoid this, measures are known in order to brake the weft thread more gently. It is known to deflect the weft thread transversely to the travel or insertion direction respectively prior to the termination of the weft insertion with the help of a pin, so that it forms a loop and as a result travels through an additional path distance. This deflection takes place for example between the pre-nozzle and the main nozzle. If the deflection is made to vanish through pivoting back or drawing back of the pin, then the elastic tension in the thread can be thereby reduced. The deflection of the weft thread however represents a heavy frictional load on the weft yarn. In the case of elastic weft yarns and/or when weaving over large widths the effect which can be achieved is often insufficient.

SUMMARY OF THE INVENTION

Thus an object of the invention is to find a remedy for this problem. Through the invention a method and an apparatus for the weft insertion in a jet weaving machine should be proposed which in particular in the case of relatively elastic weft yarns and/or large weaving widths enable a good weft insertion and largely avoid such problems as lead to a stopping of the machine, for example an undesirable jumping out of the weft thread from the main nozzle.

Thus in accordance with the invention a method for the weft insertion in a jet weaving machine is proposed, in which in each work cycle a weft thread of predeterminable length to be inserted is drawn off from a winding drum of a thread supply apparatus, the weft thread is inserted into an open shed by means of a main nozzle which is fed with a transport medium, is bound in into the cloth through the change of shed, and is severed at the cloth edge which is near the main nozzle. In each work cycle the drawing off of the weft thread to be inserted is interrupted at least once in such a manner that at first a first predeterminable thread length is released for the drawing off from the winding drum and then at least one further predeterminable thread length is also released for the drawing off from the winding drum.

Thus in accordance with the invention the drawing off of the weft thread from the winding drum of the thread supply apparatus takes place in each work cycle in at least two steps. First the first thread stopper is released for the drawing off. Then at least one further thread length is also released for the drawing off. Through this measure many problems can be solved which arise in particular when weaving with elastic weft yarns and/or at large weaving widths. Through the release of at least one further—that is, a second—thread length for example the weft thread can be intentionally detensioned. It is also possible to brake the weft thread more gently after its insertion or to forward the weft thread more reliably to the beginning of the weft insertion passage. The interruption in accordance with the invention of the drawing off of the weft thread to be inserted can be advantageously used at a plurality of time points in the work cycle, as will be discussed further below.

It is particularly advantageous when the release of the further thread length takes place in a phase which begins before the insertion of the weft thread is completed, the phase ending after the insertion of the following weft thread has begun.

Thus the drawing off of the weft thread can be interrupted before the insertion of the weft thread is completed. Then at first a first thread length is released and inserted into the shed. The first thread length is metered such that it is not sufficient for a complete weft insertion or for the reaching of the retaining or stretch nozzle respectively. As a result the weft thread is already braked towards the end of the weft insertion. Then the second thread length is released, which is metered such that the weft insertion can be completed. A more gentle braking of the weft thread results from this measure, so that stopping jolts or stretching jolts are avoided.

It is also possible that for the detensioning of the inserted weft thread one of the thread lengths is released after the insertion of the weft thread is completed and before the weft thread is bound in into the cloth through the change of shed. Through this measure the tension or the transverse tension respectively in the cloth is reduced, since the weft thread is at least partly detensioned in each case prior to its binding in.

A further preferred measure is that the portion of the inserted weft thread which is located between the main nozzle and the cloth edge is detensioned after the change of shed and prior to the severing through the release of one of the thread lengths. Through the measure of supplying an additional thread length in each case after the change of shed, which has the binding in of the weft thread into the cloth as a result, and prior to the severing of the inserted weft thread, the thread is at least partly detensioned prior to its severing, which means that the internal tensions in the thread are reduced and thus its elastic stretching is at least reduced. The thus detensioned weft thread can now be severed between the main nozzle and the cloth edge near it without the danger of a backward jumping out of the thread out of the main nozzle, which would result in a stopping of the weaving machine.

Furthermore, it is possible for one of the thread lengths to be released after the severing of the inserted weft thread and prior to the beginning of the insertion of the following weft thread in order to transport the beginning of the weft thread from the main nozzle to the beginning of the insertion passage. Through this it can be avoided that the beginning of the weft thread misses the insertion passage and forms curls.

The first thread length for the weft thread to be inserted is preferably limited by a first thread stopper and the further thread length by a second thread stopper in that after the drawing off of the first thread length the first thread stopper is brought into active connection with the winding drum, so that a further drawing off is prevented and for the further thread length the active connection between the first thread stopper and the winding drum is released, so that the further thread length is drawn off from the winding drum until a further drawing off is prevented through the active connection between the second thread stopper and the winding drum.

If more than one further thread length per cycle is to be drawn off, more than two thread stoppers are preferably provided in an analogous manner.

A thread supply apparatus having a winding drum and two thread stoppers is for example known from EP-A-0 561 218 and from U.S. Pat. No. 5,322,090 respectively. Here the second thread stopper serves to release a definite weft thread reserve in the event of a weaving stop which is caused by a faulty weft insertion in order to avoid a tearing of the weft thread between the main nozzle and the cloth edge at the insertion side. In contrast to this it is proposed through the present invention to interrupt the drawing off of the weft thread from the winding drum at least once in each work cycle. This enables in particular the elastic properties of the weft yarn to be taken into consideration.

The further thread length is preferably metered through the angular distance which the two thread stoppers have with respect to one another in regard to the peripheral direction of the winding drum. This has the advantage that the further thread length can be matched in a simple manner to the elastic properties of the respective weft yarn. The two thread stoppers are arranged in the vicinity of the outer peripheral surface of the winding drum and have an adjustable angular distance with respect to one another in regard to the peripheral direction of the winding drum. For a given radius of the winding drum then the further thread length can be set to the desired or required value respectively in that the second thread stopper is displaced relative to the first thread stopper along the peripheral direction.

Apparatus-wise an apparatus for the weft insertion in a jet weaving machine is proposed by the invention, comprising a thread supply apparatus which has a winding drum from which a weft thread of predeterminable length to be inserted can be drawn off in each work cycle, comprising a main nozzle for the insertion of the weft thread into an open shed, with it being possible for the main nozzle to be fed with a transport medium, and comprising a severing device for the severing of the weft thread at the cloth edge which is near the main nozzle. Means are provided in order to interrupt the drawing off of the weft thread to be inserted at least once in each work cycle in such a manner that at first a first predeterminable thread length is released for drawing off from the winding drum and then at least one further predeterminable thread length is also released for drawing off from the winding drum.

The means preferably comprise a first and a second thread stopper for cooperating with the winding drum and a control unit. The control unit brings the first thread stopper into active connection with the winding drum after the drawing off of the first thread length, so that a further drawing off is prevented. The active connection between the first thread stopper and the winding drum is released for supplying the further thread length so that the further thread length is drawn off from the winding drum until the active connection between the second thread stopper and the winding drum prevents a further drawing off.

It is advantageous for the thread stoppers (41, 42) to be arranged in the vicinity of the outer peripheral surface of the winding drum (3) and to have an adjustable angular distance from one another with respect to the peripheral direction. Through this measure the thread length can be adjusted in a simple manner and e.g. matched to the properties of the weft yarn.

The invention is particularly suitable for weaving with relatively elastic weft yarns. This means that the weft thread experiences a relative stretching of at least one percent during insertion. The relative stretching can however certainly also amount to more. Through the possibility of detensioning the weft thread for example prior to the severing there is no danger of the weft thread jumping out of the main nozzle.

The invention is suitable in particular for weaving carpet base cloths. Here a polypropylene material is usually used as a weft thread.

Furthermore, the invention is particularly suitable for very large weaving widths of for example more than four meters, in particular of more than five meters. In the insertion with air over such large widths a considerable drawing force must be exerted on the weft thread so that the latter experiences a very large elastic stretching. With the respective detensioning of the weft thread, e.g. prior to the end of the insertion and/or prior to the severing, undesirable machine stops can also be avoided here.

In the following the invention will be explained in more detail both in regard to the apparatus and in regard to the method with reference to exemplary embodiments and with reference to the drawings.

DESCRIPTION OF THE PREFERRED EMBODIMENTS

Figure 1:
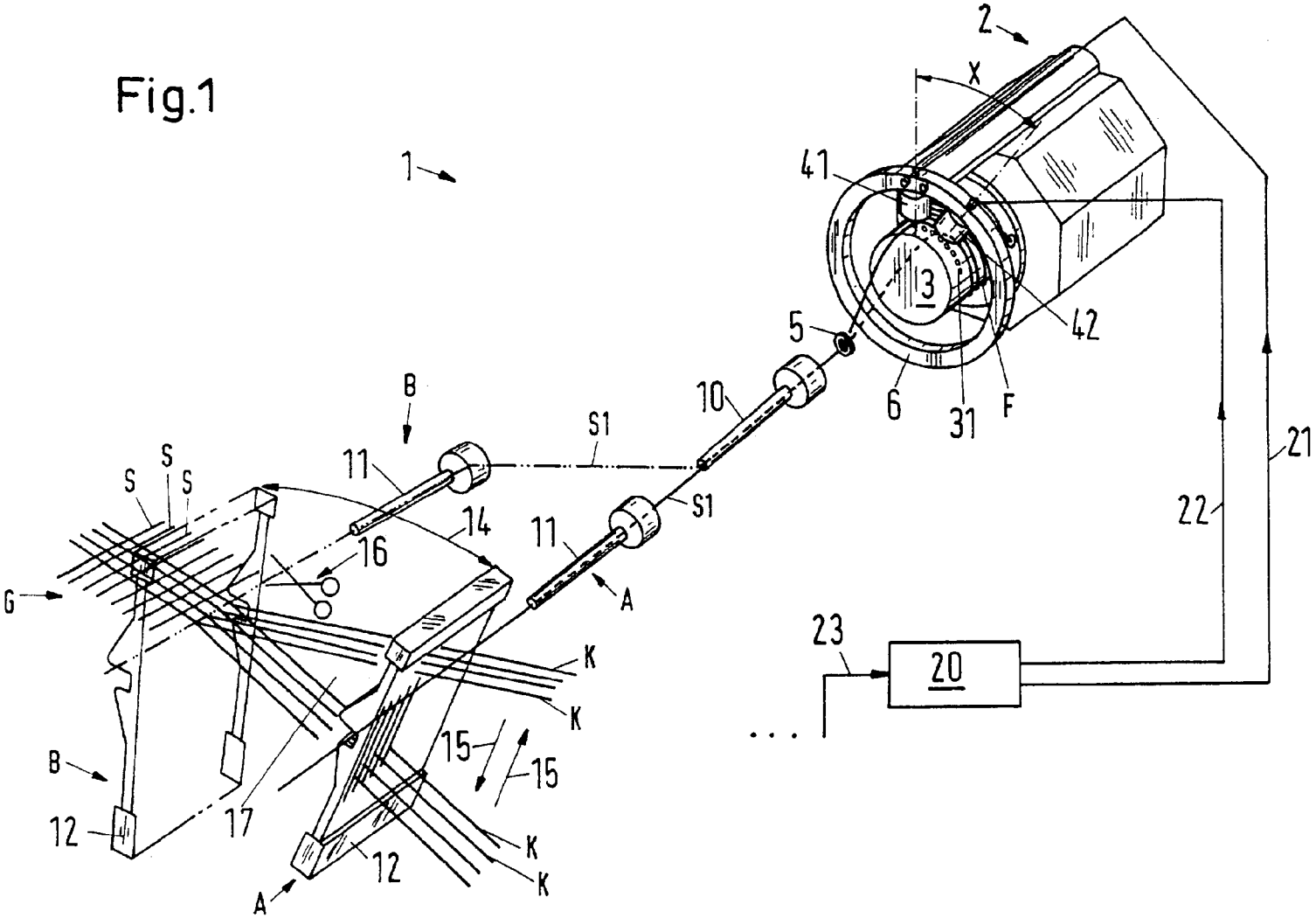
FIG. 1 is a schematic illustration of essential parts of a jet weaving machine and an exemplary embodiment of the invention.

FIG. 1 shows in a schematic illustration essential parts of a jet weaving machine, especially an air jet weaving machine, which is designated in its entirety by the reference symbol 1 and which comprises an exemplary embodiment of an apparatus in accordance with the invention for the weft insertion. For the sake of clarity, components of the air jet weaving machine which are sufficiently known per se, such as the drive, warp beam, cloth draw-off, weft thread bobbins, are not illustrated.

Figure 2:
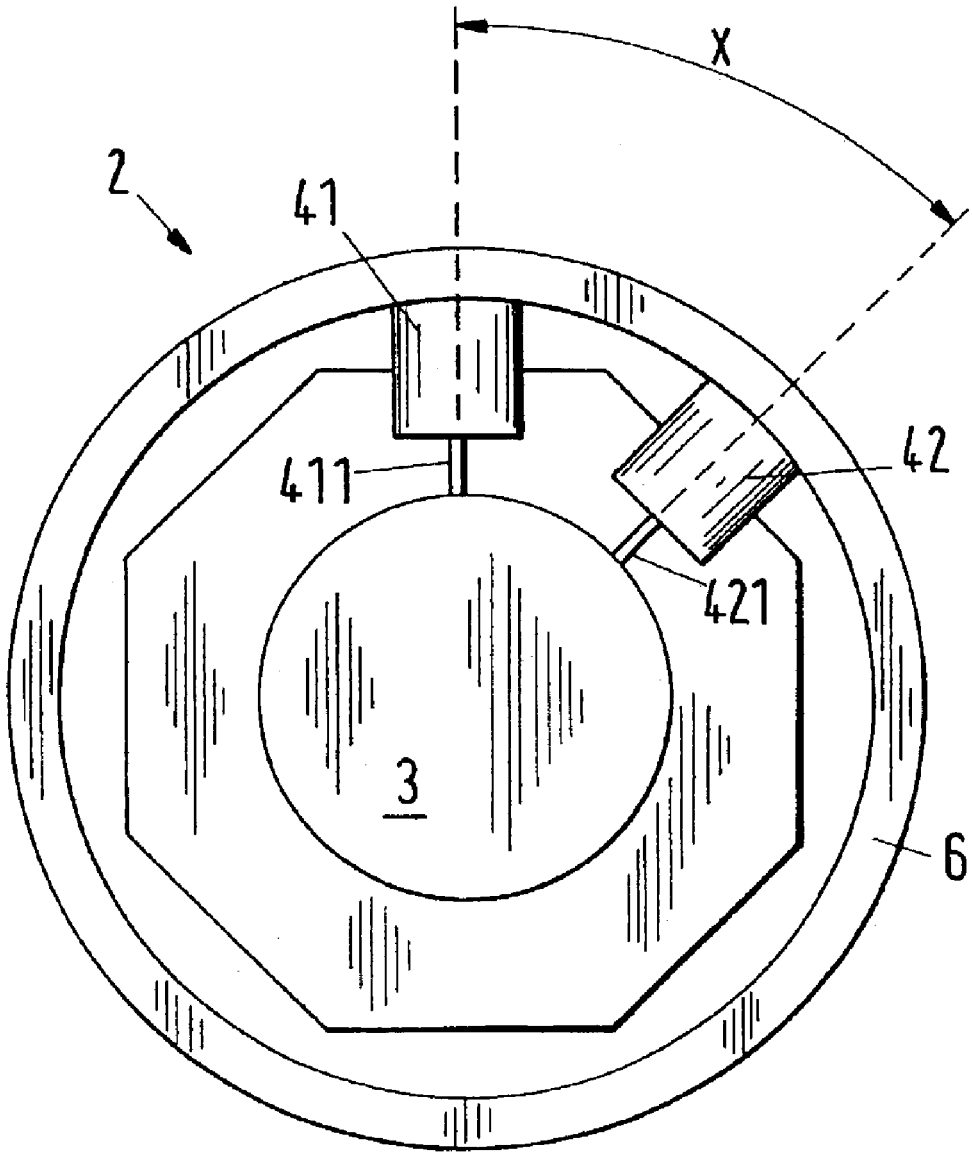
FIG. 2 is a front view of the thread supply apparatus.

The apparatus for the weft insertion in accordance with the invention comprises a thread supply apparatus 2 with a winding drum 3. FIG. 2 shows a front view of the thread supply apparatus 2. The winding drum 3 is stationarily arranged. A winding apparatus, which cannot be recognized in this illustration, draws off the thread from a thread bobbin (not illustrated) and deposits it in the form of a plurality of windings on the outer jacket surface of the winding drum 3 as a thread supply F. From the front end of the winding drum 3 in the illustration the thread supply F can be drawn off as a weft thread S1 and arrives through a guide element 5 at the nozzles for the weft insertion.

In the air jet weaving machine 1 the weft insertion takes place by means of air. In the exemplary embodiment illustrated here, two nozzles which are arranged in series are provided for the acceleration of the weft thread to be inserted, namely a pre-nozzle 10 and a main nozzle 11 (this is illustrated in two different positions A, B in FIG. 1, which will be explained below). Both nozzles are fed with air. In particular in the case of large weaving widths it has proven worthwhile to provide two nozzles 10 and 11 which are arranged one after the other at the weft side, since through this measure the path over which the weft thread S1 to be inserted can be accelerated can be increased.

The weft thread S1 is inserted through the open shed 17 ahead of the main nozzle 11. The shed 17 is formed in a known manner through a large number of warp threads K. Usually a plurality of auxiliary or relay nozzles (not illustrated) which assist the introduction of the weft thread S1 through the shed 17 are also arranged along the weft insertion path. After completion of the weft insertion a sley 12 beats up the weft thread to the cloth G, as indicated by the double arrow 14 in FIG. 1. Then a change of shed takes place, which means that the warp threads K are crossed, as the arrows 15 indicate. Through this the inserted weft thread S1 is bound in into the cloth G over the entire weaving width. Then the just inserted weft thread S1 is severed with a severing device 16 at the cloth edge which is near the main nozzle 11, so that a new thread start is ready for the next weft insertion.

In this manner the cloth G which is woven from weft threads S and warp threads K is manufactured.

In the exemplary embodiment of the air jet weaving machine 1 which is illustrated here the pre-nozzle 10 is arranged stationary with respect to the machine, whereas the main nozzle 11 is arranged in such a manner that it moves synchronously with the sley 12. For example the main nozzle 11 can be secured directly to the sley 12. Naturally other arrangements are also possible; for example both nozzles 10 and 11 could be arranged stationary with respect to the machine 1 or both can be mounted so as to be movable with the sley. It is also possible to dispense with the pre-nozzle 10 and/or to provide a longer main nozzle 11.

In FIG. 1 the weft thread S1 to be inserted, the main nozzle 11 and the sley 12 are illustrated in two positions, which correspond to the oscillatory movement of the sley 12. In the position designated by A the sley is in its position which is most remote from the cloth G. The solid-line illustration of the weft thread S1 belongs to this position A. In the position which is designated with B, to which the chain-dotted illustration of the weft thread S1 belongs, the sley 12 beats up the just inserted weft at the edge of the cloth G. The co-moving of the main nozzle 11 with the sley 12 between the positions An and B can be recognized.

The thread supply apparatus 2 comprises a first thread stopper 41 and a second thread stopper 42. Both thread stoppers 41, 42 are in each case designed such that they prevent a further drawing off of the thread from the winding drum 3 as soon as they are brought into active connection with the winding drum 3. The thread stoppers 41, 42 are preferably arranged in the vicinity of the outer peripheral surface of the winding drum 3 and are electromagnetically actuatable. In the embodiment of the thread supply apparatus 2 which is illustrated in FIG. 1 and FIG. 2 respectively a ring-shaped holder 6 is provided, which concentrically surrounds the front end (draw-off side) of the winding drum 3 in the illustration. The thread stoppers 41, 42 are mounted on the inner surface of the holder 6 which is near the winding drum 3. They can for example—as indicated in FIG. 1—be secured to the holder 6 by means of screws or fixed and guided in a rail. The thread stoppers 41 and 42 can be fixed in different angular positions relative to the outer peripheral surface of the winding drum 3. Thus the angular distance of the two thread stoppers 41, 42—illustrated in the drawing through the arc length X—can be adjusted relative to one another. The second thread stopper 42 is arranged ahead of the first thread stopper 41 in the thread draw-off direction. It is clear that more than two thread stoppers 41, 42 can be provided on the holder. An exemplary embodiment of this kind will be explained in connection with FIG. 6.

Each thread stopper 41, 42 comprises an electromagnetically actuatable pin 411 and 421 respectively which can be moved in the radial direction of the winding drum 3. Along the periphery of the winding drum 3 and arranged to lie opposite to the pins 411, 421 a plurality of bores 31 is provided in the peripheral surface of the winding drum 3, which are in each case designed to cooperate with a pin 411, 421. Instead of the bores 31 a ring groove can also be provided in order to enable a step-less displacement of the thread stoppers 41, 42. In order to produce the active connection between the respective thread stopper 41, 42 and the winding drum 3, the associated pin 411, 421 is electromagnetically actuated, so that it penetrates into the bore 31 of the winding drum lying opposite it and thus prevents a further drawing off of the thread supply F. To release the active connection the pin 411 or 421 respectively is withdrawn out of the bore 31, so that the thread supply can be drawn off from the winding drum 3.

A control unit 20 which is connected via signal lines 21, 22 to the thread stoppers 41, 42 for their actuation is provided for the control of the thread stoppers 41, 42. The control unit 20 can be integrated into the total control system of the weaving machine 1 or into the control system of the thread supply apparatus 2. The control unit 20 receives input signals, which are indicated in a summarized manner by the signal line 23. The input signals comprise for example signals which indicate the correct arrival of the weft thread S1 or other sensor signals. With the help of the input signals the control unit 20 determines for each thread stopper the times at which the active connection with the winding drum 3 is to be produced or released respectively and transmits the corresponding control signals to the thread stoppers 41, 42 via the signal lines 21 and 22.

It is now proposed in accordance with the invention that in each work cycle the drawing off of the weft thread S1 to be inserted is interrupted at least once in such a manner that at first a first predeterminable thread length is released for drawing off from the winding drum 3 and then at least one further predeterminable thread length is also released to be drawn off from the winding drum 3. Thus in each work cycle the weft thread is drawn off from the winding drum in at least two steps. This quasi stepwise drawing off of the weft thread enables for example an intentional detensioning of the weft thread to be realized in each case at one or more time points of the work cycle.

This will now be explained with reference to an exemplary embodiment in which the weft thread is drawn off from the winding drum 3 in two steps in each work cycle. Initially a first thread length is drawn off from the winding drum and then a further—that is, a second—thread length is released for the drawing off in order to detension the inserted weft thread prior to the severing at the insertion side.

During operation, for the insertion of a weft thread a predeterminable first thread length, which is dependent on the weaving width, is first drawn off from the winding drum 3 and inserted by means of the nozzles 10, 11 into the open shed 17. On completion of the weft insertion, which means when the predetermined first thread length has been drawn off from the winding drum 3, which can be determined in a manner which is known per se by means of non-illustrated sensors, the two thread stoppers 41 and 42 are brought into active connection with the winding drum 3 through a corresponding signal of the control unit 20. The pins 411, 421 penetrate into the bores 31 of the winding drum 3 lying respectively opposite to them. The thread which comes from the winding drum 3 then lies in contact at the pin 411 of the first thread stopper 41 and cannot be drawn off further. In FIG. 1 this is illustrated by the solid-line illustration of the thread at the winding drum 3. After the just inserted weft thread has been beat up at the cloth (position B of the sley 12) and has been bound in into the cloth G through the change of shed, the control unit 20 releases the active connection between the first thread stopper 41 and the winding drum 3. Now the thread can again be drawn off from the winding drum 3, namely until the thread lies in contact at pin 421 of the second thread stopper 42 (chain-dotted illustration), which is still in active connection with the winding drum 3. Through this measure the second thread length is released, the length of which is determined through the arc length X. This second thread length serves to detension the weft thread and at least to reduce its elastic stretch prior to severing. After the second thread length has been released and the inserted weft thread S1 is thereby detensioned, the weft thread S1 is severed by means of the severing device 16 at the cloth edge adjacent to the main nozzle, so that again a new thread start is ready for the next weft insertion. For the following weft insertion the active connection between the second thread stopper 42 and the winding drum 3 is released in the succeeding weaving cycle.

It is not necessary to bring the first and the second thread stopper 41 and 42 respectively into active connection with the winding drum 3 at the same time point; what is essential is that the active connection between the second thread stopper 42 and the winding drum 3 is present when the active connection between the first thread stopper 41 and the winding drum 3 is released.

The length of the second thread length, which is released after each weft insertion and prior to each severing for the detensioning of the thread, is metered or adjusted respectively via the relative angular distance of the two thread stoppers 41 and 42 from one another, that is, via the arc length X, and is matched to the respective conditions, e.g. elasticity module of the weft thread, stretching of the weft thread, force acting on the weft thread, etc.

If different weft yarns are being worked with (multiple weft insertion), then the additional thread length can be adjusted individually at each thread supply apparatus 2 for the associated weft yarn.

This exemplary embodiment is suitable in particular for weaving with very elastic weft threads, for example for the manufacture of carpet base cloths, in which weft yarn consisting of polypropylene is typically used and/or for very large weaving widths of four meters and more, in which strong drawing forces are exerted on the weft thread through the transport medium. Through the respective detensioning of each inserted weft thread after the change of shed and prior to the severing, an undesirable escaping of the thread from the nozzle is effectively prevented and thus an uneconomical weaving stop is avoided.

Figure 3:
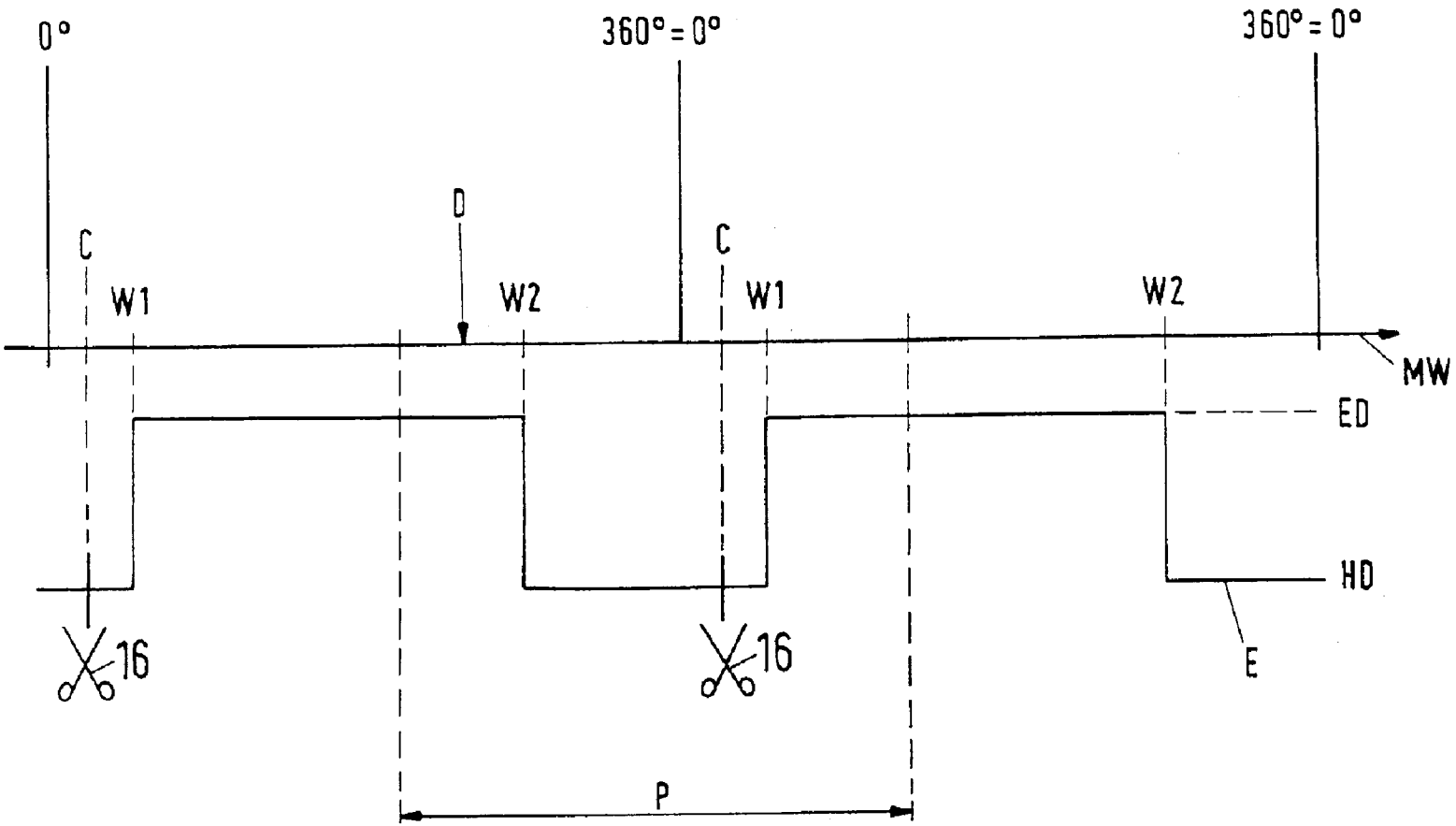
FIG. 3 is a diagram for illustrating the work cycle.

The release of at least one further thread length can take place at different time points of the work cycle of the weaving machine 1 depending on the desired effect. For a better comprehension FIG. 3 shows a schematic illustration of the work cycle of an air jet weaving machine 1. As usual in general, the work cycle is described through the angle of rotation of the main shaft of the machine. This angle is plotted in FIG. 3 on the axis MW. Two work cycles are illustrated, each of which extends from 0° to 360°. In the present example the zero point, that is, 0° or 360° respectively, is the time point, i.e. the angle, at which the sley 12 beats up the weft thread S1 at the cloth. The curve E shows the greatly simplified compressed air behavior in the main nozzle 11. The pressure alternates between the blow-in pressure ED, which is present during the weft insertion, and the significantly lower retaining pressure HD, which is present between two successive weft insertions and which holds and stretches the beginning of the weft thread after the severing. The weft insertion begins at an angle of W 1; the main nozzle 11 is charged with the blow-in pressure ED and accelerates the weft thread to be inserted into the open shed 17. At angle W2 the weft insertion is completed; the main nozzle 11 is charged with the lower retaining pressure HD. At 0° or 360° respectively the inserted weft thread is beat up at the cloth G. This usually takes place overlapping with the change of shed. At angle C the severing of the weft thread at the insertion side with the severing device 16 takes place.

The release of the further thread length preferably takes place within a phase which begins before the insertion of the weft thread has ended, the phase ending after the insertion of the following weft thread has begun. This phase P is drawn in in FIG. 3.

In the above-described variant, in which the weft thread is detensioned in each case after the binding in into the cloth and before the severing at the insertion side, the release of the further thread length takes place at an angle which lies between 0° and C.

Further advantageous variants will be explained in the following: The further thread length can for example be released before the end of the weft insertion, e.g. at the angle D. First the first thread length is drawn off from the winding drum 3. Before reaching the angle D, then the two thread stoppers 41 and 42 are brought into active connection with the winding drum 3, through which the first thread length is limited. At angle D the first thread stopper 41 is then released, through which a further thread length is released for drawing off from the winding drum. In this the further thread length is metered through the position of the second thread stopper 42 such that it is sufficient for the completion of the weft insertion. The measure has the advantage that the weft thread is braked more gently, through which stopping jolts or stretching jolts respectively are avoided. Prior to the final braking of the weft thread, a detensioning of the weft thread takes place. The release of the first thread stopper 41 takes place before its mass is completely braked through the lying in contact at the first thread stopper 41 under a high rise in tension. The rest of the braking of the weft thread then takes place only through the second thread stopper 42. Thus in this variant an additional thread length is provided in order to brake the weft thread more gently through a detensioning.

Another variant consists in releasing one or the further thread length after the insertion of the weft thread has been completed and before the weft thread has been completely bound in into the cloth through the change of shed, thus approximately in the region of 0°. The inserted weft thread is detensioned during the beating up, but, however, still prior to its complete binding in through the crossing of the warp threads. Through this general, intentional detensioning of the weft thread prior to its binding in into the cloth the transverse tension of the cloth and thus its jumping in can be reduced.

Figure 4:
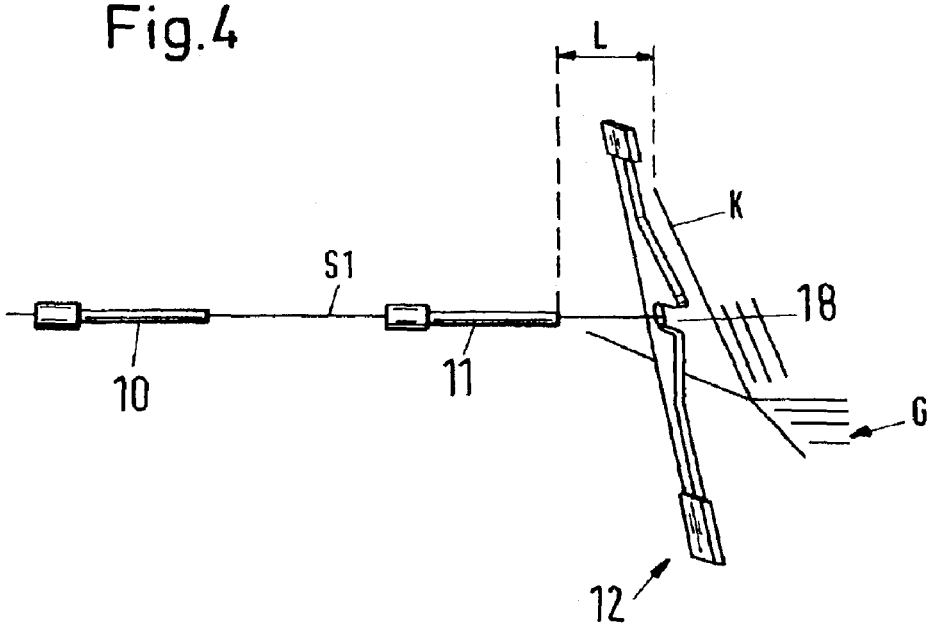
FIG. 4 shows a detail of FIG. 1.

Furthermore, the variant is possible of releasing one or the further thread length after the severing of the inserted weft thread and prior to the beginning of the insertion of the following weft thread in order to transport the beginning of the weft thread from the main nozzle to the beginning of the insertion passage. The release of the further thread length thus takes place between C and W1. This variant will be explained with reference to FIG. 4, which represents a detail of FIG. 1. The pre-nozzle and main nozzle 10, 11, the weft thread S1 to be inserted, the beginning of the sley 12 and the beginning of the insertion passage 18 can be recognized. After the previous weft thread was severed at the insertion side, the beginning of the new weft thread is held in the main nozzle 11 through the retaining air flow (retaining pressure HD). The thread start is typically located in the region of the outlet of the main nozzle 11 which is near the cloth edge. If now the further thread length is released, then the beginning of the weft thread is transported into the position shown in FIG. 4, namely to the beginning of the insertion passage 18, and stretched. It can possibly be advantageous or necessary to increase the retaining pressure somewhat. If now the main nozzle is charged with the significantly higher blow-in pressure ED, the beginning of the weft thread to be inserted is already located at the beginning of the insertion passage 18 and can no longer miss the latter.

There is frequently a selvedge tucking device for the forming of the cloth edge located between the cloth edge and the end of the main nozzle 11 which is near it. This has as a result that the main nozzle 11 cannot be provided directly at the beginning of the insertion passage. Thus the weft thread must first overcome the relatively large distance L between the outlet of the main nozzle 11 and the beginning of the insertion passage 18, with it being possible for turbulences to arise in addition. If the weft thread is accelerated out of the main nozzle with the high blow-in pressure ED, then there is the danger that the beginning of the weft thread misses the insertion passage 18. This leads to the forming of curls or kinks in the weft thread, which usually result in the stopping of the machine. This problem can be solved through the variant described in the preceding, since through the release of the thread length prior to the switching on of the high blow-in pressure the beginning of the weft thread is already transported to the beginning of the insertion passage 18 through the substantially lower retaining pressure HD or a pressure which is increased slightly with respect to the retaining pressure respectively. Undesirable stopping of the weaving machine can also be avoided through this variant.

Figure 5:
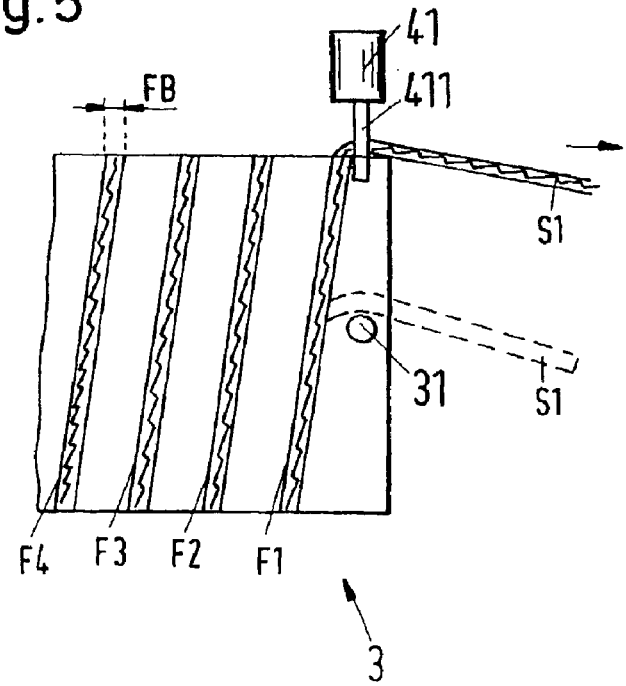
FIG. 5 is a detailed illustration of the front end of the winding drum.

A further advantageous effect which can be achieved with the detensioning of the weft thread through the release of a further thread length will be explained with reference to FIG. 5. FIG. 5 shows in a side view the front end of the winding drum 3, from which the weft thread S1 is drawn off. The thread supply is wound up on the winding drum 3 in the form of a plurality of windings F1, F2, F3, F4. The situation which is illustrated in FIG. 5 corresponds for example to the state after the completion of the weft insertion. The weft thread S1 was drawn off from the winding drum 3 in the direction of the arrow and now lies in contact at a thread stopper, here at pin 411 of the first thread stopper 41. Not illustrated for reasons of draftsmanship is the second thread stopper 42, the pin of which engages into the illustrated bore 31. Through the usually very strong braking of the weft thread at the termination of the insertion, it happens that the first winding or the first of the windings F1–F4 draws itself tight or binds. They are drawn very strongly against the winding drum through the drawing force during the braking of the weft thread and are quasi lashed tight. This can lead to considerable problems at the beginning of the next weft insertion. If the thread stopper 41 is released for the next weft insertion, then it takes too long until the thread can be released from the periphery of the winding drum by means of the blow-in pressure. This leads to weft insertion errors and thus to a stopping of the machine. The invention can also be advantageously used for the solution of this problem. After the termination of the weft insertion, when the weft thread S1 lies in contact at pin 411, as is illustrated in FIG. 5 in solid lines, the active connection between the first thread stopper 41 and the winding drum 3 is released through a drawing back of the pin 411. Through this the releasing or the loosening respectively of the thread on the winding drum is already begun by means of the retaining pressure HD or, where appropriate, of a somewhat increased retaining pressure. If the thread departs completely from the winding drum through charging with the retaining pressure, it comes to lie in contact at the pin of the second thread stopper 42, which is not illustrated in FIG. 5, and which engages in the bore 31. The thread is then located in the position which is illustrated in broken lines in FIG. 5. A further drawing off of the thread is avoided through the second thread stopper. In any case, it is ensured that the weft thread and in particular the first winding F1 can be drawn off from the winding drum without problem at the beginning of the next weft insertion.

The problem of the drawing tight or binding of the windings F1–F4 arises in particular in the case of band-shaped weft materials. For example in the manufacture of some carpet base cloths, a polypropylene band with a thread width FB (FIG. 5) of several millimeters, for example 3 mm, is used as a weft thread. Here it can be effectively avoided through the described release of the further thread length that problems arise during the following weft insertion through a binding of the windings.

The effect of the release of the weft thread from the winding drum 3 automatically arises as a positive accompanying effect in some of the above described variants, for example when a further thread length is released after the termination of the weft thread insertion and prior to the severing of the thread at the insertion side.

It is evident that the different variants can be combined with one another in any desired manner. Thus it is possible to release two or more further thread lengths for drawing off in each work cycle. For example a further thread length can at first be released—as already described—prior to termination of the weft insertion in order to brake the weft thread more gently; and then yet a further thread length can be released after the binding in of the weft thread in order to detension the weft thread prior to the severing between the main nozzle 11 and the cloth edge.

In particular when a plurality of further thread lengths are to be released per work cycle it is advantageous for more than two thread stoppers to be provided.

Figure 6:
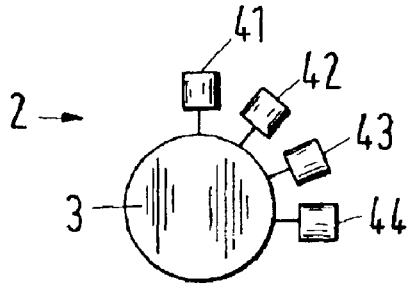
FIG. 6 is a schematic illustration of another exemplary embodiment of a thread supply apparatus.

FIG. 6 shows parts of another exemplary embodiment of a thread supply apparatus 2 in a schematic illustration. Here a total of four thread stoppers 41, 42, 43, 44 are provided for cooperating with the winding drum 3. The angular distance with respect to the peripheral direction between adjacent thread stoppers is preferably adjustable in a manner analogous to that explained above. With the embodiment which is shown in FIG. 6 it is possible to release more than one additional thread length in each work cycle. For this, for example, the active connections between the thread stoppers 41–44 are successively released in order to release further thread lengths for drawing off one after the other.

The exemplary embodiment which is illustrated in FIG. 6 is suitable in particular for uses in which work is done with different weft thread lengths. For example there are cloths in which only every other weft is laid in into the cloth edge after its insertion. Correspondingly an insertion with greater weft thread length (long weft) always takes place in alternation with an insertion with smaller weft thread length (short weft). In such uses for example the thread stoppers 41 and 43 can be used as described above for the short wefts and the thread stoppers 42 and 44 in an analogous manner for the long wefts. This in each work cycle at least one further thread length can be released for drawing off from the winding drum even when working with different weft thread lengths.

What is claimed is:

1. Apparatus for inserting weft threads in a jet weaving machine, comprising a thread supply apparatus having a winding drum from which, in each work cycle, a weft thread of predeterminable length to be inserted can be drawn off, a main nozzle for the insertion of the weft thread into an open shed, it being possible for said main nozzle to be fed with a transport medium, a severing device for severing the weft thread at the cloth edge which is near the main nozzle, and a thread withdrawal device for interrupting the drawing off of the weft thread to be inserted at least once during each work cycle in such a manner that at first a first predeterminable thread length is released for the drawing off from the winding drum and then at least one further predeterminable thread length is released for drawing off from the winding drum.

2. Apparatus in accordance with claim 1 wherein the device comprises first and second thread stoppers cooperating with the winding drum and a control unit, the control unit bringing the first thread stopper into active connection with the winding drum after the drawing off of the first thread length so that a further drawing off is prevented, and the active connection between the first thread stopper and the winding drum being released for the supplying of the further thread length, so that the further thread length is drawn off from the winding drum until an active connection between the second thread stopper and the winding drum prevents a further drawing off.

3. Apparatus in accordance with claim 1 wherein the thread stoppers are arranged in a vicinity of an outer peripheral surface of the winding drum and have an adjustable angular distance from one another with respect to a peripheral direction.

4. A method for inserting weft threads in a jet weaving machine for weaving a cloth comprising drawing off a predeterminable length of a weft thread from a winding drum during each work cycle of the machine, inserting the weft thread into an open shed with a main nozzle which is fed with a transport medium, binding the weft thread into the cloth by changing the shed, severing the weft thread at an edge of the cloth near the main nozzle, and interrupting the drawing off of the weft thread to be inserted at least once during each work cycle by releasing at first a first predeterminable thread length to be drawn off the winding drum and thereafter releasing at least one further predeterminable thread length to be drawn off the winding drum.

5. A method according to claim 4 including interrupting the drawing off of the weft thread before completing inserting the weft thread.

6. A method according to claim 4 including releasing one of the thread lengths after completing inserting the weft thread and before binding the weft thread into the cloth through the change of the shed to thereby at least partially detension the inserted weft thread.

7. A method according to claim 4 wherein the further predeterminable thread length is located between the main nozzle and the cloth edge, and including at least partially detensioning the further predeterminable thread length following the change of the shed, by releasing at least one of the predeterminable thread lengths, and thereafter severing the inserted weft thread.

8. A method according to claim 4 including severing the inserted weft thread following the changing of the shed, and releasing one of the thread lengths following the severing of the inserted weft thread and prior to beginning inserting a following weft thread for transporting a start of the following weft thread on the winding drum from the main nozzle to a beginning of an insertion passage.

9. A method according to claim 4 including providing the jet weaving machine with first and second stoppers arranged spaced apart from each other proximate the winding drum for engaging the weft thread on the winding drum, limiting the first predeterminable thread length being inserted by engaging the first thread length with the first stopper to prevent a further drawing off of the weft thread from the winding drum, limiting the further predeterminable thread length by engaging the further predeterminable thread length with the second stopper, and releasing the first stopper so that the further predeterminable thread length is drawn off the winding drum until a further drawing off is prevented by the engagement of the weft thread by the second stopper.

10. An air jet weaving machine comprising a thread supply apparatus having a winding drum from which, in each work cycle, a weft thread of predeterminable length to be inserted can be drawn off, a main nozzle for the insertion of the weft thread into an open shed, it being possible for said main nozzle to be fed with a transport medium, a severing device for severing the weft thread at the cloth edge which is near the main nozzle, and a thread withdrawal device for interrupting the drawing off of the weft thread to be inserted at least once during each work cycle in such a manner that at first a first predeterminable thread length is released for the drawing off from the winding drum and then at least one further predeterminable thread length is released for drawing off from the winding drum.

11. A method for inserting weft threads in an air jet weaving machine for weaving a cloth comprising directing the weft thread with a flow of air into an open shed on the weaving machine during an operating cycle of the machine by drawing the weft thread off a weft thread supply, prior to commencing a new operating cycle changing the shed to thereby bind the inserted thread to the cloth, and interrupting the drawing off of the weft thread by first releasing a first predetermined length of the weft thread from the weft thread supply for insertion into the shed and thereafter releasing a further predetermined length of the weft thread from the weft thread supply.

12. A method according to claim 11 wherein interrupting comprises stopping drawing off weft thread from the supply between releasing the first and second predetermined thread lengths.

13. A method according to claim 11 wherein releasing the further predetermined length a weft thread includes preventing a remainder of the weft thread on the weft thread supply from being drawn off the weft thread supply.

14. A method according to claim 13 including severing the further predetermined length of weft thread from the remainder while the remainder is prevented from being drawn off the weft thread supply.

* * * * *